US005484107A

United States Patent [19]

Holmes

[11] Patent Number: 5,484,107

[45] Date of Patent: Jan. 16, 1996

[54] THREE-FLUID ATOMIZER

[75] Inventor: Michael J. Holmes, Alliance, Ohio

[73] Assignee: The Babcock & Wilcox Company, New Orleans, La.

[21] Appl. No.: 242,227

[22] Filed: May 13, 1994

[51] Int. Cl.[6] ..... B05B 7/04

[52] U.S. Cl. ..... 239/427.5; 239/428

[58] Field of Search ..... 239/428–431, 239/433, 422, 419.3, 427.5

[56] References Cited

U.S. PATENT DOCUMENTS

| | | | |
|---|---|---|---|
| 191,546 | 6/1877 | Parson | 239/428 |
| 2,879,948 | 3/1959 | Seibel | 239/428 |
| 3,074,697 | 1/1963 | Friedell | 239/428 |
| 3,326,472 | 6/1967 | Gjerde | 239/428 |
| 4,462,543 | 7/1984 | Yam | 239/428 |
| 4,819,878 | 4/1989 | Bailey et al. | 239/427 |
| 5,129,583 | 7/1992 | Bailey et al. | 239/427 |

FOREIGN PATENT DOCUMENTS

| | | | |
|---|---|---|---|
| 2129710 | 5/1984 | United Kingdom | 239/419.3 |

OTHER PUBLICATIONS

Clyde Orr, Jr.; Particulate Technology, 1966; Title page, Table of Contents, Ch. 1, pp. 1–43, Ch. 3 pp. 87–123, Ch. 4 pp. 124–178, Ch. 10, pp. 490–506.

W. L. McCabe and J. C. Smith, Unit Operations of Chemical Engineering, 3d Ed., 1976; Title page, Table of Contents, Ch. 9 pp. 221–264.

*Primary Examiner*—Karen B. Merritt

*Attorney, Agent, or Firm*—Robert P. Bennett, Jr.; Robert J. Edwards

[57] ABSTRACT

An atomizer for internally mixing two fluids (usually liquids) by way of momentum supplied by a compressible third fluid (usually air or steam) and for discharging a jet of a finely atomized mixture of the three fluids. The energy from these high velocity jets also causes additional mixing of the three fluids external to the nozzle head as well as intimate mixing with the surroundings. The atomizer includes: a nozzle head defining a space for receiving a mixture containing the three fluids; a nozzle hole through the nozzle head for discharging the jet; and first, second and third fluid supply conduits connected to the nozzle head for supplying the first, second and third fluids to the nozzle head. The first fluid supply conduit has an aperture through the conduit wall so that the first and second fluids combine before being further mixed and dispersed by the third fluid. The second fluid supply conduit is positioned concentrically about the first fluid supply conduit and the third fluid supply conduit is positioned concentrically about the second fluid supply conduit.

3 Claims, 1 Drawing Sheet

THREE-FLUID ATOMIZER

BACKGROUND OF THE INVENTION

1. Field of the Invention

The present invention relates in general to a multiple fluid atomizer, and more particularly to an internal mix atomizer and a method for mixing fluids within the atomizer.

2. Description of the Related Art

Dual fluid atomization is a method which uses the momentum supplied by a compressible fluid (usually air or steam) to break up a second fluid (usually a liquid) into very fine droplets. In many applications it is necessary to mix a third fluid into the atomized liquid and surrounding fluid (usually a gas). For the case described here, this is done by internally mixing the liquid, the compressible fluid, and the third fluid, and spraying the mixture into the surroundings through small orifices in the nozzle of the atomizer. The momentum of the atomizer jets will provide rapid mixing of these three fluids and the surrounding gas in addition to breaking up the liquids. Such a technique may be applied to beneficially introduce mixtures into a chemical reactor or a boiler.

Typically, a tank equipped with an agitator has been used to mix a second fluid into a liquid. The agitator provides the energy needed for the initial mixing and thereafter operates to maintain the mixture. The mixed fluid is then transported from the tank to the reactor or boiler with the mixture being maintained during transport by using one or more in-line mixers. Keeping fluids mixed can be especially difficult in applications where the two fluids are immiscible or where a solid that has a tendency to settle out is mixed in. This method of mixing has certain economic and operational drawbacks. The agitator and in-line mixer(s) require a capital outlay for their purchase and installation and further expenditures for their operation and upkeep, including expenses for the energy needed to operate them. In addition, preparing the mixture in a tank limits the ability to change the mixture ratio in response to variations in reactor or boiler operating conditions. An additional concern arises in applications where there are competing side reactions in the two fluids if they are mixed for too long before entering the reactor.

Dual fluid atomizer designs are known which utilize a compressible fluid such as steam or air to atomize another fluid which may be a gas, a liquid, or a liquid which is laden with suspended solid particles (a slurry). (See U.S. Pat. No. 5,129,583 and U.S. Pat. No. 4,819,878.) Nothing in either of these two references suggests use of the compressible fluid to internally mix a second and a third fluid and to break up the resulting mixture into fine droplets. Other references of interest are Clyde Orr, Jr. Particulate Technology, Macmillan Company, New York, 1966; and W. L. McCabe and J. C. Smith, Unit Operations of Chemical Engineering, Third Edition, McGraw-Hill Book Company, New York, 1976.

SUMMARY OF THE INVENTION

The present invention involves alteration of the design of an existing dual fluid atomizer to permit the flow of three fluids into the atomizer. (See U.S. Pat. No. 5,129,583 assigned to the same assignee as the present invention.) Very generally, the alteration entails interposing another fluid supply conduit between the two fluid supply conduits of the existing design and providing holes through the periphery of the innermost supply conduit. The holes allow the fluid contained in the innermost fluid supply conduit (fluid 1) and the fluid contained in the interposed fluid supply conduit (fluid 2) to flow together before they enter a mixing chamber where a third fluid (fluid 3) is introduced from the outermost fluid supply conduit. In the mixing chamber, fluid 1 and fluid 2, which may be liquids, are violently mixed by the energy supplied from fluid 3, which may be air or steam, and the three-fluid mixture flows out of the mixing chamber first through a vestibule and then through holes in a nozzle head of the atomizer. The mixture of the three fluids exits the nozzle head holes at very high velocities (near sonic) and forms turbulent jets which cause the mixture to break up into fine droplets. The energy from these high velocity jets also causes additional mixing of the three fluids external to the nozzle head as well as intimate mixing with the surroundings.

The present invention thus provides an advantageous alternative to the typical means of fluid mixing which employs a mixing tank equipped with an agitator and a transport means equipped with one or more in-line mixers. In many cases, the present invention, by mixing fluids in the atomizer, eliminates the need for the mixing tank agitator and the in-line mixer(s). The economic and operational drawbacks associated with these devices and with the overall mixing arrangement are overcome by the present invention. The capital outlay required to purchase and install the agitator and the in-line mixer(s), as well as the expenditures for their operation and upkeep, can be avoided. In addition to saving purchase, installation and operation costs of typical mixing equipment, the present invention permits nearly instantaneous changes in the mixture ratio. Because the fluids are mixed just upstream of the reactor or furnace, the ratio of the different fluids to the total flow can be changed almost instantaneously. Process control techniques may be utilized to alter the mixture ratio on the basis of changes in key reactor or furnace operating variables. Keeping the fluids separate until the atomizer will also prevent chemical reactions from occurring until just before the reactor. In certain applications unwanted side reactions between fluids 1 and 2 can be prevented by keeping them separate until the atomizer.

Accordingly, an object of the present invention is to provide an atomizer and a method for internally mixing a first fluid and a second fluid by means of a third fluid and for discharging a jet of a mixture of the three fluids.

The atomizer comprises: a nozzle head defining a space for receiving a mixture containing the first, second and third fluids; a nozzle hole through the nozzle head for discharging the jet; first fluid supply means connected to the nozzle head for supplying the first fluid to the nozzle head; second fluid supply means connected to the nozzle head for supplying the second fluid to the nozzle head; third fluid supply means connected to the nozzle head for supplying the third fluid to the nozzle head; and the nozzle hole having an inlet end in communication with the space and an outlet end for discharging the jet from the space.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which the preferred embodiment of the invention is illustrated.

DESCRIPTION OF THE PREFERRED EMBODIMENT

Figure 1:
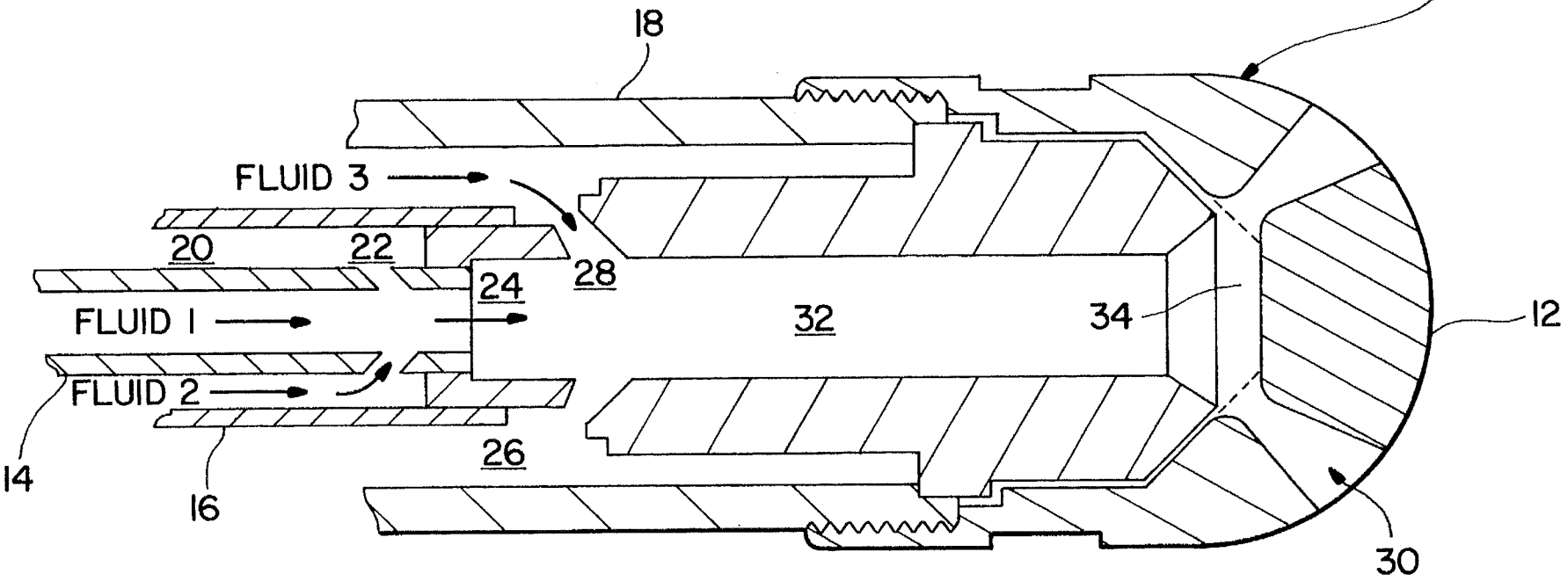
FIG. 1 is a sectional view, partially in elevation, of an atomizer in accordance with the present invention.

Referring to the drawing in particular, the invention embodied in FIG. 1 comprises an atomizer generally designated (10) having a hollow nozzle head (12) which defines a vestibule (34) for receiving a mixture of a first and a second fluid (such as two liquids) in a third fluid (such as air or other gas). The first and second fluids may be a liquid (such as oil or water), a slurry (such as fly ash and water or coal-water fuel), a gas (such as ammonia), or a solid-laden gas (such as air and limestone). The third fluid is generally expandable to help mix and disperse the first and the second fluids and to help discharge a jet of a finely atomized fluid mixture through one or more nozzle holes (30) extending in the nozzle head (12).

The first fluid is supplied through a first fluid supply conduit (14). The second fluid is supplied by a second fluid supply conduit (16) which is concentrically positioned about the first fluid supply conduit (14) and which thereby defines a first annular fluid passage (20). From passage (20), the second fluid flows through an aperture (22) in the wall of the first fluid supply conduit (14) and combines therein with the first fluid. The first fluid and the second fluid flow through opening (24) to a mixing chamber (32). The expandable third fluid is supplied by a third fluid supply conduit (18) which is concentrically positioned about the second fluid supply conduit (16) and which thereby defines a second annular fluid passage (26). The expandable third fluid flows from passage (26) through opening (28) to the mixing chamber (32). In the mixing chamber (32), the expandable third fluid violently combines with the first fluid and the second fluid and thereby serves to mix and disperse them. Supply lines (not shown) for the first, second and third fluids are connected to the respective fluid supply conduits (14), (16) and (18). Conduit (18) mechanically supports the nozzle head (12).

While a specific embodiment of the invention has been shown and described in detail to illustrate the application of the principles of the invention, it will be understood that the invention may be embodied otherwise without departing from such principles. For example, the invention includes the option to mix more than three fluids.

What is claimed is:

1. A method for mixing a first fluid, a second fluid and a compressible third fluid in an atomizer, comprising the steps of:

supplying a first fluid, which is a member selected from the group consisting of a liquid, a gas, a slurry, and a solid-laden gas, through a first fluid supply conduit being of a constant inside diameter extending over the entire length of said conduit and said conduit being connected to a nozzle head defining a space for receiving a mixture containing the first, second and third fluids;

supplying a second fluid, which is a member selected from the group consisting of a liquid, a gas, a slurry, and a solid-laden gas, through a second fluid supply conduit connected to the nozzle head and positioned concentrically about the first fluid supply conduit to define a first annular fluid passage;

combining the first fluid and the second fluid within the first fluid supply conduit by allowing the second fluid to flow through an aperture in the wall of the first fluid supply conduit at a position near the outlet end of the first fluid supply conduit;

supplying a compressible third fluid, which is a member selected from the group consisting of a gas and a solid-laden gas, through a third fluid supply conduit connected to the nozzle head and positioned concentrically about the second fluid supply conduit to define a second annular fluid passage;

combining, in a mixing chamber, the compressible third fluid with the first fluid and the second fluid by allowing the third fluid to flow through an opening in the wall of the mixing chamber, the opening being positioned near the inlet end of the mixing chamber and extending directly between the second annular passage and the mixing chamber so that the third fluid has a straight flow path from the second annular passage to the mixing chamber;

transporting a mixture of the first fluid, the second fluid, and the third fluid through the mixing chamber and directly thereafter through the space defined by the nozzle head; and discharging from the space defined by the nozzle head a jet of the mixture of the first fluid, the second fluid and the compressible third fluid through at least one hole in the nozzle head.

2. A triple fluid atomizer for mixing and discharging a jet of a first fluid, a second fluid and a compressible third fluid into a boiler or a chemical reactor, comprising:

a nozzle head defining a space for receiving a mixture containing the first, second and third fluids;

at least one nozzle hole through said nozzle head for discharging the jet;

a first fluid supply conduit connected to said nozzle head for supplying a first fluid to said nozzle head, said conduit being of a constant inside diameter extending over the entire length of said conduit and having an aperture through a wall of said conduit, which aperture is positioned near the outlet end of said conduit;

a second fluid supply conduit connected to said nozzle head for supplying a second fluid to said nozzle head and positioned concentrically about said first fluid supply conduit to define a first annular fluid passage from which said second fluid flows through said aperture into said first fluid supply conduit and combines in said first fluid supply conduit with said first fluid; and a third fluid supply conduit connected to said nozzle head for supplying a third fluid to said nozzle head and positioned concentrically about said second fluid supply conduit to define a second annular fluid passage.

3. A triple fluid atomizer for mixing and discharging a jet of a first fluid, a second fluid and a compressible third fluid into a boiler or a chemical reactor, comprising:

a nozzle head defining a space for receiving a mixture containing the first, second and third fluids;

at least one hole through said nozzle head for discharging the jet;

a first fluid supply conduit connected to said nozzle head for supplying a first fluid, which is a member selected from the group consisting of a liquid, a gas, a slurry and a solid-laden gas, to said nozzle head, said conduit being of a constant inside diameter extending over the entire length of said conduit and having an aperture through a wall of said conduit, which aperture is positioned near the outlet end of said conduit;

a second fluid supply conduit connected to said nozzle head for supplying a second fluid, which is a member selected from the group consisting of a liquid, a gas, a slurry and a solid-laden gas, to said nozzle head and positioned concentrically about said first fluid supply conduit to define a first annular fluid passage from which said second fluid flows through said aperture into said first fluid supply conduit and combines in said first fluid supply conduit with said first fluid; and a third fluid supply conduit connected to said nozzle head for supplying a third fluid, which is a member selected from the group consisting of a gas and a solid-laden gas, to said nozzle head and positioned concentrically about said second fluid supply conduit to define a second annular fluid passage.

* * * * *